US008418449B2

(12) United States Patent
Tatur et al.

(10) Patent No.: US 8,418,449 B2
(45) Date of Patent: Apr. 16, 2013

(54) VARIABLE EXHAUST GAS DEFLECTOR

(75) Inventors: Marek Tatur, Auburn Hills, MI (US); Dean Tomazic, Orion Township, MI (US)

(73) Assignee: FEV GmbH, Aachen (DE)

( * ) Notice: Subject to any disclaimer, the term of this patent is extended or adjusted under 35 U.S.C. 154(b) by 784 days.

(21) Appl. No.: 12/237,509

(22) Filed: Sep. 25, 2008

(65) Prior Publication Data

US 2010/0071352 A1 Mar. 25, 2010

(51) Int. Cl.
*F01N 1/00* (2006.01)
*F02B 31/00* (2006.01)

(52) U.S. Cl.
USPC ..... 60/324; 123/306

(58) Field of Classification Search ..... 60/280, 60/322, 324; 123/306
See application file for complete search history.

(56) References Cited

U.S. PATENT DOCUMENTS

| | | | | |
|---|---|---|---|---|
| 3,549,273 | A * | 12/1970 | Bird et al. | 416/241 R |
| 5,144,796 | A * | 9/1992 | Swars | 60/288 |
| 6,401,449 | B1 | 6/2002 | Hofmann et al. | |
| 2002/0023799 | A1 * | 2/2002 | Schlossarczyk et al. | 181/254 |
| 2006/0162690 | A1 * | 7/2006 | Kim | 123/306 |
| 2007/0051097 | A1 * | 3/2007 | Klein | 60/286 |
| 2007/0080020 | A1 * | 4/2007 | Emmett | 181/237 |
| 2007/0128054 | A1 * | 6/2007 | Wrench et al. | 417/413.1 |
| 2008/0223956 | A1 * | 9/2008 | Jinnai et al. | 239/265.35 |
| 2010/0043413 | A1 * | 2/2010 | Orihashi et al. | 60/320 |
| 2010/0089468 | A1 * | 4/2010 | Scott et al. | 137/468 |

FOREIGN PATENT DOCUMENTS

| | | | |
|---|---|---|---|
| WO | WO 2008101105 | A2 * | 8/2008 |
| WO | WO 2009007775 | A1 * | 1/2009 |

* cited by examiner

*Primary Examiner* — Kenneth Bomberg
*Assistant Examiner* — Audrey K Bradley
(74) *Attorney, Agent, or Firm* — Gifford, Krass, Sprinkle, Anderson & Citkowski, P.C.

(57) ABSTRACT

A variable exhaust gas flow deflector for an internal combustion engine is disclosed. The deflector can include a blade located at least partially within an exhaust gas flow of the engine, the blade having a first position and a second position. The blade can move between the first position and the second position as a function of at least one parameter and/or condition of the exhaust gas and/or the internal combustion engine.

17 Claims, 3 Drawing Sheets

VARIABLE EXHAUST GAS DEFLECTOR

FIELD OF THE INVENTION

The present invention relates to a deflector for exhaust gas, and in particular, to a variable deflector for exhaust gas from an internal combustion engine.

BACKGROUND OF THE INVENTION

The treatment of exhaust gas from internal combustion engines with particulate filters and/or nitrogen oxide absorbers is known. In some systems, selective catalytic reduction (SCR) is used to convert nitrogen oxides into harmless molecules. For example, urea injection into the exhaust gas before passing through the catalytic converter can convert nitrogen oxides into $N_2$, $H_2O$ and $CO_2$, with thorough mixing of the exhaust gas with the urea critical in order to achieve high regeneration/conversion rates. However, most exhaust gas piping does not have a sufficient straight section prior to the catalytic converter and/or a particulate filter in order for the exhaust gas to be uniformly introduced to the converter and/or filter. As such a non-uniform field of temperature and/or reduction substance can develop and lead to reduced conversion rates in the converter. In addition, damage due to thermal distortions can occur in particulate filters.

Deflectors of exhaust gas are known to those skilled in the art. However, heretofore deflectors have had limited success and do not adequately deflect the exhaust gas over a variety of engine operating conditions. As such, an exhaust gas deflector that is variable and affords for uniform gas flow into a catalytic converter and/or particulate filer, despite changing exhaust gas parameters, would be desirable.

SUMMARY OF THE INVENTION

A variable exhaust gas flow deflector for an internal combustion engine is disclosed. The deflector can include a blade located at least partially within an exhaust gas flow of the engine, the blade moveable between a first position and a second position. The blade can move between the first position and the second position as a function of at least one parameter or condition of the exhaust gas. In some instances, the blade can include a plurality of blades. The blade can move between the first position and the second position as a function of a temperature of the exhaust gas, a flow rate of the exhaust gas, an amount of catalytic substance (e.g. urea) introduced into the exhaust gas and the like.

The blade can be made from a bi-metallic material, the bi-metallic material including a first material with a first coefficient of expansion and a second material with a second coefficient of expansion. The first coefficient of expansion is not equal to the second coefficient of expansion, and the difference in the first and second coefficients of expansion affords for the blade to exhibit movement as a temperature of the blade increases or decreases. It is appreciated that the blade temperature can increase or decrease as a result of the temperature of the exhaust gas that flows past and/or comes into contact with the blade.

The blade can be attached to a base. The base can be in the form of a base ring or in the alternative in the form of a first base ring and a second base ring that is spaced apart from the first base ring. If two base rings are included, the blade can be pivotally attached to the first base ring and the second base ring. In addition, the second base ring can be operable to move and/or rotate relative to the first base ring, the movement of the second base ring affording the blade to move between the first position and the second position.

The variable exhaust gas flow deflector can also include an actuator that is operable to move the blade between the first position and the second position. For example, the actuator can afford for movement of the second base ring relative to the first base ring. The actuator can include a gear and/or a slidable arm. In addition, the actuator can afford movement of the blade as a function of a temperature of the exhaust gas flow, the exhaust gas flow rate, the amount of catalytic substance introduced into the exhaust gas and the like.

DETAILED DESCRIPTION OF THE INVENTION

Figure 1:
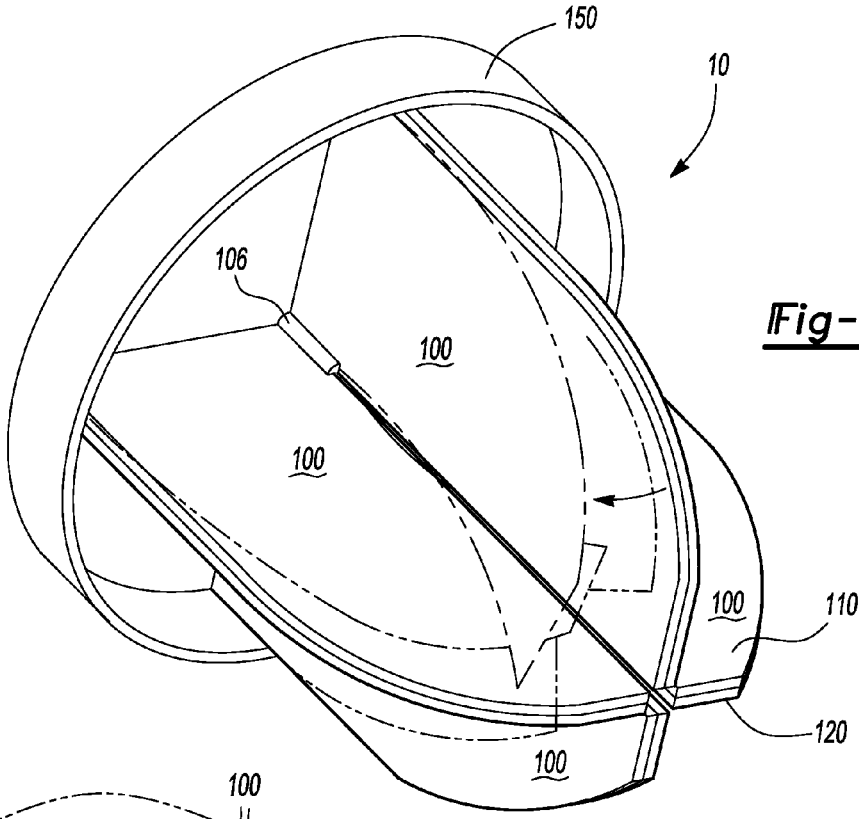
FIG. 1 is a perspective view of an embodiment of the present invention illustrating a blade in a first position.

The present invention discloses a variable exhaust gas flow deflector for an internal combustion engine. As such, the variable exhaust gas flow deflector has utility as a component for an internal combustion engine.

The variable exhaust gas flow deflector includes a blade that is located at least partially within exhaust gas piping of the engine, the blade having a first position and a second position and being operable to move between the first position and the second position as a function of at least one condition of the engine and/or the exhaust gas. It is appreciated that the term exhaust gas piping includes exhaust gas tubing, exhaust gas passages, exhaust gas line and the like. It is further appreciated that more than one blade can be included within the variable exhaust gas flow deflector. In some instances, the blade moves between the first position and the second position as a function of a temperature of the exhaust gas, a mass flow rate for the exhaust gas and/or a quantity of catalytic substance (e.g. urea) introduced into the exhaust gas.

The blade can be made from a bimetallic material, the bimetallic material having a first material with a first coefficient of expansion and a second material with a second coefficient of expansion. In some instances, the first coefficient of expansion is not equal to the second coefficient of expansion and the difference between the first and second coefficients affords for the blade to exhibit movement as a temperature of the blade increases or decreases. As such, as exhaust gas from the internal combustion engine increases in temperature and flows past and/or contacts the blade, the blade exhibits movement as its temperature increases, thereby altering its position from the first position to the second position. In this manner, the flow of the exhaust gas can be altered as a function of temperature.

The blade can also be made from a single material that has a single coefficient of expansion and an actuator can be used to afford for the blade to move between the first position and the second position. For example and for illustrative purposes only, the blade can have an end that is attached to a base and the actuator can apply a force to the blade and thereby move it between the first position and the second position. In some instances, the base can be the exhaust gas piping itself, while in other instances, a base ring can be provided with the blade pivotally attached thereto. In some instances, a first base ring and a second base ring are included, with the two rings spaced apart from each other and the blade pivotally attached to each. Movement and/or rotation of the second base ring relative to the first base ring results in movement or tilting of the blade in the same direction as the movement of the second base ring. Tilting of the blade can result in an altered flow of the exhaust gas and can be performed as a function of at least one condition and/or parameter of the gas. In some instances, the second base ring can have ridges, for example in the form of gear teeth, that can be engaged by a gear. Rotation of the gear thus results in rotation of the second base ring and movement of the blade. In other instances, a slidable arm having a flange thereon can engage at least one of the ridges on the second base ring, sliding of the arm resulting in movement of the second base ring and thus movement of the blade.

Turning now to FIGS. 1-4, an embodiment of a variable exhaust gas flow deflector is shown generally at reference numeral 10. The deflector 10 can include a blade 100 or a plurality of blades 100, the blade 100 being made from a first material 110 and a second material 120. In some instances, the first material 110 has a first coefficient of expansion and the second material 120 has a second coefficient of expansion. It is appreciated that the first material 110 is rigidly attached to the second material 120, for example by using welding, diffusion bonding, threaded fasteners, adhesives and the like. In addition, the blade 100 can have an end that is attached to a base 150, or in the alternative be attached directly to an exhaust gas pipe 101. In addition, if more than one blade 100 is included, the blades can also be attached to each other using a fastener 106. The fastener 106 can be any fastener known to those skilled in the art, illustratively including welding, adhesives, threaded fasteners and the like. In addition, it is appreciated from FIGS. 1-3 that the fastener 106 is located at and/or along a generally central location or axis of the exhaust gas pip 101 and the blades 100 extend from the generally central location or axis in an outward direction towards the exhaust gas pipe 101.

Figure 2:
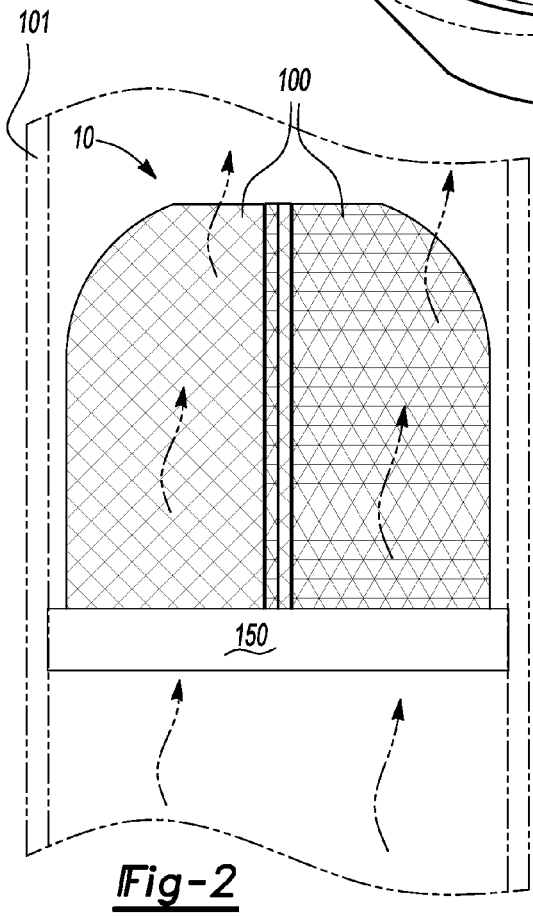
FIG. 2 is a side view of the embodiment shown in FIG. 1.
Figure 3:
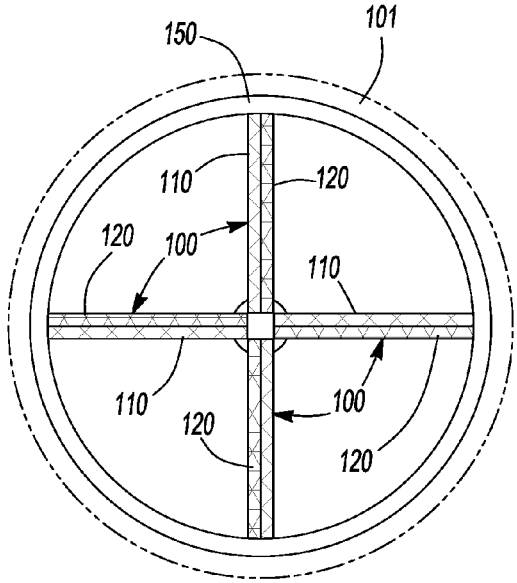
FIG. 3 is a top view of the embodiment shown in FIG. 1.
Figure 4:
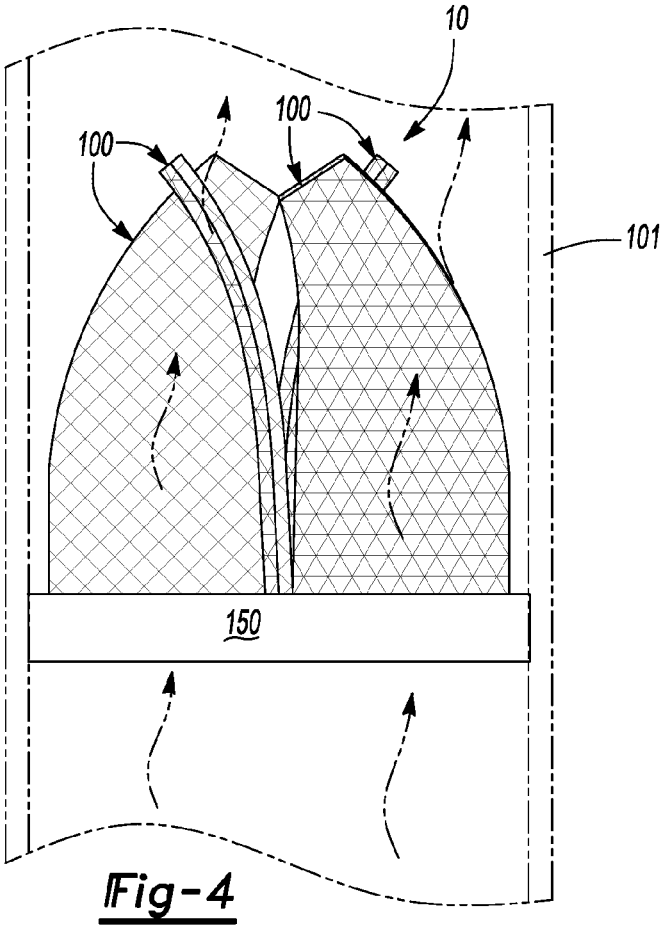
FIG. 4 is a side view of the embodiment shown in FIG. 2 illustrating the blade having moved from the first position to a second position.

In operation, the deflector 10 is placed within an exhaust gas flow as illustrated in FIG. 2, for example within an exhaust gas pipe 101. For example, the blade 100 can be attached to the base 150 which can then be placed within exhaust gas piping 101. It is appreciated that the exhaust gas originates from an internal combustion engine and has a temperature that is higher than ambient temperature. As the exhaust gas flows past and/or contacts the blade 100, a temperature of the blade increases. The material 110 or 120 having the larger coefficient of expansion expands more than the material having the smaller coefficient of expansion, thereby resulting in a bending movement as illustrated in FIG. 4. In the alternative, as the blade 100 cools down, the bending of the blade decreases and the blade returns to its original shape and/or position. It is appreciated that the blade 100 bends along a direction that is generally parallel with the flow of the exhaust gas within the exhaust gas pipe 101 and/or along an elongated direction of the blade 100.

The first material 110 and the second material 120 can be selected such that a desired amount of movement of the blade 100 is obtained during the normal operation of the internal combustion engine. In addition, the location of the first material 110 and the second material 120 with respect to the blade 100 can be selected such that all of the plurality of blades 100 exhibit movement or bending in generally the same direction or in the alternative in different directions. Furthermore, it is appreciated that one or more of the blades can be made from only one material and thus remains stationary or unbent during operation of the internal combustion engine. Thus a first material and a second material can be selected, and along with appropriate placement and/or design of the blades, movement of the blades 100 can afford for uniform temperature distribution and/or the delivery of uniformly mixed exhaust plus catalytic substance within a particulate filter, catalytic converter and the like. It is also appreciated from the figures that the uniformly mixed exhaust gas can occur across an entire cross section of the exhaust gas piping.

Figure 5:
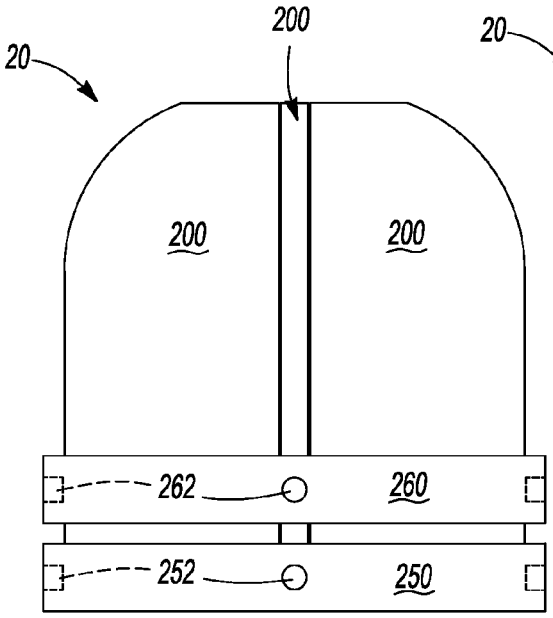
FIG. 5 is a side view of another embodiment of the present invention illustrating a blade in a first position.
Figure 6:
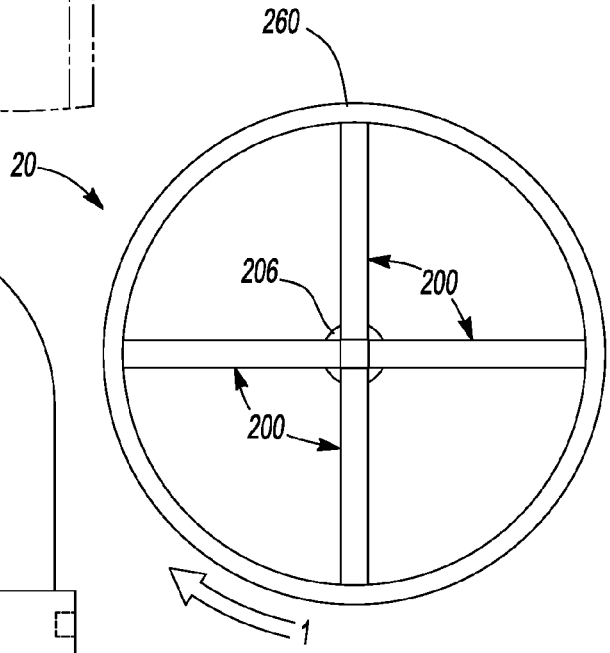
FIG. 6 is a top view of the embodiment shown in FIG. 5.
Figure 7:
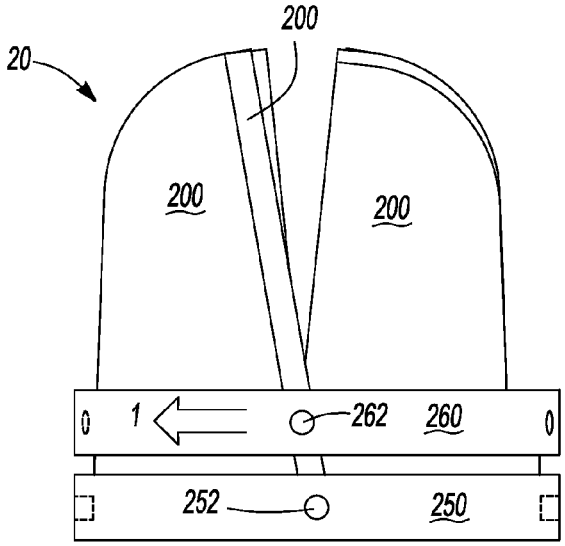
FIG. 7 is a side view of the embodiment shown in FIG. 5 illustrating the blade having moved from a first position to a second position.

Turning now to FIGS. 5-9, another embodiment of an exhaust gas flow deflector is shown generally at reference numeral 20. In contrast to the deflector 10 where movement of the blade 100 is provided by exploitation of material properties, the deflector 20 affords for movement of a blade 200 by mechanical means. As shown in FIG. 5 and for illustrative purposes only, the blade 200 can be attached to a first base 250 and a second base 260. In some instances, the first base 250 can be in the form of a ring as is the second base 260. The blade 200 can be pivotally attached to the first base 250 and/or the second base 260 using a pin 252 and/or pin 262, respectively and movement and/or rotation of base 250 and/or 260 relative to the other base results in a tilting movement of the blade 200. An example of such movement is shown in FIG. 7 where the second base 260 is moved in a first direction 1 relative to the first base 250. It is appreciated that more than one blade 200 can be included in the deflector 20 and that one or more of the blades 200 can be attached to the first base 250 and/or the second base 260 such that one or more of the blades 200 exhibits movement when one of the bases is moved relative to the other.

Figure 8:
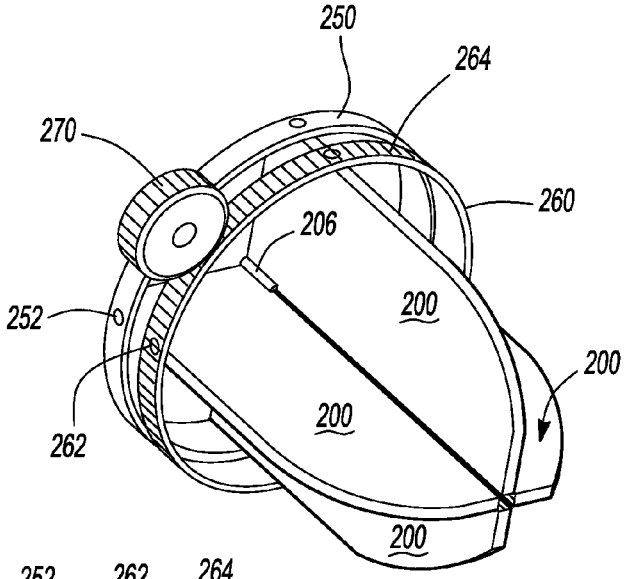
FIG. 8 is a perspective view of the embodiment shown in FIG. 5 illustrating an actuator that includes a gear.
Figure 9:
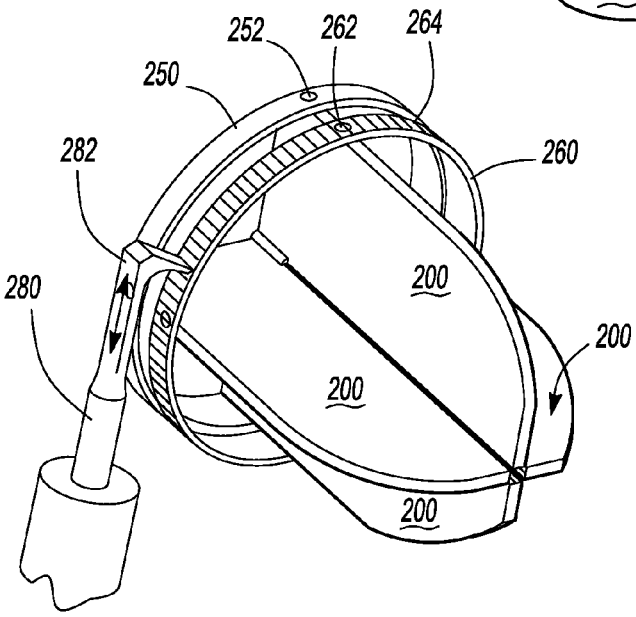
FIG. 9 is a perspective view of the embodiment shown in FIG. 5 illustrating an actuator that includes a slidable arm.

Looking specifically at FIGS. 8 and 9, an example of an actuator that can move the first base 250 or second base 260 is shown. In particular, FIG. 8 illustrates an actuator that includes a gear 270, the gear 270 operable to engage teeth 264 that are present on the second base 260. Thus rotation of the gear 270 can afford for rotation of the base 260 and thus movement of the blade 200. Looking specifically at FIG. 9, an actuator that includes a slidable arm 280 with a flange 282 extending therefrom is shown. The flange 282 can likewise engage one or more of the teeth 264 on the second base 260 with sliding movement of the slidable arm 280 resulting in movement of the base 260 relative to the base 250. It is appreciated that the actuator can be in communication with a sensor, electronic control unit and the like such that movement of the blade 200 as a function of a condition and/or parameter of the exhaust gas and/or internal combustion engine can be provided. It is further appreciated that the internal combustion engine can any combustion engine where variable deflection of the exhaust gas is desired, for example and for illustrative purposes only a two-stroke or four-stroke diesel engine, a two-stroke or four-stroke gasoline engine and the like.

The blade, base and actuator can be made from any material known to those skilled in the art, illustratively including metals, ceramics and the like. In particular, metallic materials such as steels, stainless steels, nickel based alloys, cobalt based alloys, refractory materials and the like can be used for the blades. The invention is not restricted to the illustrative examples and embodiments described above. The examples and the embodiments are not intended as limitations on the scope of the invention. Methods, apparatus, compositions and the like described herein are exemplary and not intended as limitations on the scope of the invention. Changes therein and other uses will occur to those skilled in the art. As such, the scope of the invention is defined by the scope of the claims.

We claim:

1. A variable exhaust gas flow deflector for an internal combustion engine comprising:

a plurality of blades located at least partially within exhaust gas piping having a cylindrical wall;

each of said plurality of blades made from a bi-metallic material, said bi-metallic material having a first material with a first coefficient of expansion and a second material with a second coefficient of expansion, said first coefficient of expansion not being equal to said second coefficient of expansion;

each of said plurality of blades having a first straight position and a second bent position, and also operable to bend between said first straight position and said second bent position as a function of an exhaust gas temperature within said exhaust gas piping, each of said plurality of blades being spaced a predetermined distance from said cylindrical wall to permit full flow of an exhaust gas when each of said plurality of blades is in said second bent position and provide for at least one of a uniform temperature distribution and a uniform mixing of the full flow of the exhaust gas across an entire cross section of said exhaust gas piping when the exhaust gas is passing through said exhaust gas piping by swirling the exhaust gas as it passes through said plurality of blades;

each of said plurality of blades also extending from a central location of said exhaust gas piping outwardly to said predetermined distance from said cylindrical wall.

2. The variable exhaust gas flow deflector of claim 1, wherein each of said blades made from said bi-metallic material exhibits tilting as a temperature of said blade increases or decreases.

3. The variable exhaust gas flow deflector of claim 1, wherein each of said plurality of blades bends along a direction that is parallel to an exhaust gas flow within said exhaust gas piping.

4. The variable exhaust gas flow deflector of claim 1, wherein each of said plurality of blades bends along an elongated direction of each blade.

5. The variable exhaust gas flow deflector of claim 1, wherein each of said plurality of blades are attached to each other with a fastener located at said central location.

6. The variable exhaust gas flow deflector of claim 1, wherein said exhaust gas piping is a single wall exhaust gas piping.

7. A process for adjusting an exhaust gas flow of an engine having variable operating conditions, the process comprising:

providing an engine having an exhaust gas pipe having a cylindrical wall;

providing a variable exhaust gas flow deflector within said exhaust gas pipe, the variable exhaust gas flow deflector having a plurality of blades made from a bi-metallic material, the bi-metallic material having a first material with a first coefficient of expansion and a second material with a second coefficient of expansion, the first coefficient of expansion not being equal to the second coefficient of expansion and the difference in the coefficient of expansion between the first material and the second material resulting in each of the plurality of blades bending as a temperature of each blade increases or decreases, each blade extending outwardly from a central location of the exhaust gas piping and having a first straight position and a second bent position within the exhaust gas pipe, each blade operable to move between the first straight position and the second bent position;

flowing exhaust gas from the engine through the exhaust gas pipe; and changing the position of each blade as temperature of the exhaust gas changes, with each of the plurality of blades being spaced a predetermined distance from the cylindrical wall to permit full flow of the exhaust gas when each of blade is in the second bent position and provide for at least one of a uniform temperature distribution and a uniform mixing of the full flow of the exhaust gas across an entire cross section of said exhaust gas piping when the exhaust gas is passing through the exhaust gas piping by swirling the exhaust gas as it passes through the plurality of blades.

8. The process of claim 7, wherein each of the plurality of blades are attached to each other with a fastener located at the central location.

9. The process of claim 7, wherein the exhaust gas piping is a single wall exhaust gas piping.

10. A variable exhaust gas flow deflector for an internal combustion engine comprising:

a plurality of blades located at least partially within exhaust gas piping having a cylindrical wall;

each of said plurality of blades made from a bi-metallic material, said bi-metallic material having a first material with a first coefficient of expansion and a second material with a second coefficient of expansion, said first coefficient of expansion not being equal to said second coefficient of expansion;

each of said plurality of blades having a first straight position and a second bent position, and also operable to bend between said first straight position and said second bent position as a function of an exhaust gas temperature within said exhaust gas piping, each of said plurality of blades being spaced a predetermined distance from said cylindrical wall to permit full flow of an exhaust gas when each of said plurality of blades is in said second bent position and provide for at least one of a uniform temperature distribution and a uniform mixing of the full flow of the exhaust gas across an entire cross section of said exhaust gas piping when the exhaust gas is passing through said exhaust gas piping by swirling the exhaust gas as it passes through said plurality of blades;

each of said plurality of blades also extending from a generally central location of said exhaust gas piping outwardly to said predetermined distance from said cylindrical wall and are attached to each other with a fastener located at said central location.

11. The variable exhaust gas flow deflector of claim 10, wherein said exhaust gas piping is a single wall exhaust gas piping.

12. A variable exhaust gas flow deflector for an internal combustion engine comprising:

a plurality of blades located at least partially within a single wall exhaust gas piping having a cylindrical wall;

each of said plurality of blades made from a bi-metallic material, said bi-metallic material having a first material with a first coefficient of expansion and a second material with a second coefficient of expansion, said first coefficient of expansion not being equal to said second coefficient of expansion;

each of said plurality of blades having a first straight position and a second bent position, and also operable to bend between said first straight position and said second bent position as a function of an exhaust gas temperature within said exhaust gas piping, each of said plurality of blades being spaced a predetermined distance from said cylindrical wall to permit full flow of an exhaust gas when each of said plurality of blades is in said second bent position and provide for at least one of a uniform temperature distribution and a uniform mixing of the full flow of the exhaust gas across an entire cross section of said exhaust gas piping when the exhaust gas is passing through said exhaust gas piping by swirling the exhaust gas as it passes through said plurality of blades;

each of said plurality of blades also extending from a central location of said exhaust gas piping outwardly to said predetermined distance from said cylindrical wall.

13. The variable exhaust gas flow deflector of claim 12, wherein each of said plurality of blades are attached to each other with a fastener located at said central location.

14. A process for adjusting an exhaust gas flow of an engine having variable operating conditions, the process comprising:

providing an engine having an exhaust gas pipe having a cylindrical wall;

providing a variable exhaust gas flow deflector within said exhaust gas pipe, the variable exhaust gas flow deflector having a plurality of blades made from a bi-metallic material, the bi-metallic material having a first material with a first coefficient of expansion and a second material with a second coefficient of expansion, the first coefficient of expansion not being equal to the second coefficient of expansion and the difference in the coefficient of expansion between the first material and the second material resulting in each of the plurality of blades bending as a temperature of each blade increases or decreases, each blade extending outwardly from a central location of the exhaust gas piping and attached to each other with a fastener located at the central location, each blade having a first straight position and a second bent position within the exhaust gas pipe and operable to move between the first straight position and the second bent position;

flowing exhaust gas from the engine through the exhaust gas pipe; and changing the position of each blade as temperature of the exhaust gas changes, with each of the plurality of blades being spaced a predetermined distance from the cylindrical wall to permit full flow of the exhaust gas when each blade is in the second bent position and provide for at least one of a uniform temperature distribution and a uniform mixing of the full flow of the exhaust gas across an entire cross section of said exhaust gas piping when the exhaust gas is passing through the exhaust gas piping by swirling the exhaust gas as it passes through the plurality of blades.

15. The process of claim 14, wherein the exhaust gas piping is a single wall exhaust gas piping.

16. A process for adjusting an exhaust gas flow of an engine having variable operating conditions, the process comprising:

providing an engine having a single wall exhaust gas pipe having a cylindrical wall;

providing a variable exhaust gas flow deflector within said exhaust gas pipe, the variable exhaust gas flow deflector having a plurality of blades made from a bi-metallic material, the bi-metallic material having a first material with a first coefficient of expansion and a second material with a second coefficient of expansion, the first coefficient of expansion not being equal to the second coefficient of expansion and the difference in the coefficient of expansion between the first material and the second material resulting in each of the plurality of blades bending as a temperature of each blade increases or decreases, each blade extending outwardly from a central location of the exhaust gas piping and having a first straight position and a second bent position within the exhaust gas pipe, each blade operable to move between the first straight position and the second bent position;

flowing exhaust gas from the engine through the exhaust gas pipe; and changing the position of each blade as temperature of the exhaust gas changes, with each of the plurality of blades being spaced a predetermined distance from the cylindrical wall to permit full flow of the exhaust gas when each blade is in the second bent position and provide for at least one of a uniform temperature distribution and a uniform mixing of the full flow of the exhaust gas across an entire cross section of said exhaust gas piping when the exhaust gas is passing through the exhaust gas piping by swirling the exhaust gas as it passes through the plurality of blades.

17. The process of claim 16, wherein each of the plurality of blades are attached to each other with a fastener located at the central location.

* * * * *

UNITED STATES PATENT AND TRADEMARK OFFICE

CERTIFICATE OF CORRECTION

PATENT NO. : 8,418,449 B2
APPLICATION NO. : 12/237509
DATED : April 16, 2013
INVENTOR(S) : Marek Tatur et al.

It is certified that error appears in the above-identified patent and that said Letters Patent is hereby corrected as shown below:

In the Claims

At column 6, claim number 7, line number 12, Delete "of".

Signed and Sealed this
Seventeenth Day of June, 2014

Michelle K. Lee

Michelle K. Lee
*Deputy Director of the United States Patent and Trademark Office*